US009944094B1

(12) United States Patent
Herrmann et al.

(10) Patent No.: US 9,944,094 B1
(45) Date of Patent: Apr. 17, 2018

(54) VACUUM MEDIA DRUM TRANSPORT SYSTEM WITH SHUTTER FOR MULTIPLE MEDIA SIZES

(71) Applicant: Xerox Corporation, Norwalk, CT (US)

(72) Inventors: Douglas K. Herrmann, Webster, NY (US); Jason M. LeFevre, Penfield, NY (US); Derek A. Bryl, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/481,604

(22) Filed: Apr. 7, 2017

(51) Int. Cl.
*B41J 11/00* (2006.01)

(52) U.S. Cl.
CPC ..... *B41J 11/0085* (2013.01)

(58) Field of Classification Search
CPC ..... B41J 11/0085; B65H 5/224; B65H 5/226; B65H 11/005; B65H 29/243; B65H 2406/32; B65H 2406/322; B65H 2406/3221; B65H 2406/3222; B65H 2406/36
See application file for complete search history.

(56) References Cited

U.S. PATENT DOCUMENTS

| | | | | |
|---|---|---|---|---|
| 5,099,277 | A | 3/1992 | Lucht et al. | |
| 6,543,948 | B2 | 4/2003 | Beehler et al. | |
| 6,672,720 | B2 | 1/2004 | Smith | |
| 6,969,066 | B2 | 11/2005 | Ferrarese et al. | |
| 8,240,661 | B2 | 8/2012 | Bober | |
| 9,815,303 | B1 * | 11/2017 | Herrmann | B65H 11/005 |

* cited by examiner

*Primary Examiner* — Juanita D Jackson
(74) *Attorney, Agent, or Firm* — Maginot Moore & Beck LLP

(57) ABSTRACT

A media transport system includes a drum with a plurality of rows of holes, a vacuum plenum, and a shutter. The vacuum plenum is positioned within the drum at a position opposite a printhead and the shutter is configured for movement in a cross-process direction. Each row of holes in the drum includes at least one inter-copy gap. The shutter includes a solid member having at least one aperture in it. The shutter is moved to a position so the aperture is aligned with a row of holes and the solid portion of the shutter prevents a flow of air through the vacuum plenum from the holes in other rows of holes not aligned with the aperture in the shutter and the inter-copy gaps in the row of holes aligned with the aperture selectively prevents air flow to the vacuum plenum.

19 Claims, 5 Drawing Sheets

VACUUM MEDIA DRUM TRANSPORT SYSTEM WITH SHUTTER FOR MULTIPLE MEDIA SIZES

TECHNICAL FIELD

This disclosure is directed to printers and, more particularly, to media drum transport systems for print media in inkjet printers.

BACKGROUND

Inkjet printers form printed images using one or more printheads, each one of which includes an array of inkjet ejectors. A controller in the printer operates the ejectors to form printed images that often include both text and graphics and may be formed using one or more ink colors. Some inkjet printers receive and carry print media, such as paper sheets, envelopes, or any other article suitable for receiving printed images, on a drum past one or more printheads to receive the ink drops that form the printed image. Many printers that use drums to transport print media include a vacuum plenum and holes in the drum to generate a suction force through the surface of the drum. Each print medium engages a portion of the holes on the surface of the drum and the suction force holds the print medium to the surface of the drum to prevent the print media from slipping or otherwise moving relative to the surface of the drum as the drum rotates the media past the printheads. Holding each print medium in place relative to the surface of the moving drum enables the printer to control the timing of the operation of printheads to ensure that the printheads form printed images in proper locations on each print medium and ensures that the print media do not cause jams or other mechanical issues with the printer. In large-scale printer configurations, the drum can carry a plurality of print media simultaneously.

One problem with drums that carry print media over a vacuum plenum is that the print media often do not completely cover every hole in the drum. For example, as a drum carries two or more print media, a gap between sheets of consecutive print media can include holes exposed to the vacuum plenum. The relative locations of gaps on the drum often change between print jobs that use print media of different sizes. The suction force of the vacuum plenum draws air through the exposed holes near the edges of the print media, which produces airflow. In regions around the printheads, the airflow can affect the paths of ink drops as the ink drops travel from the printhead to the surface of the print medium, which can reduce the accuracy of drop placement and degrade image quality, particularly near the leading and trailing edges of the print media. For example, FIG. 6 depicts printed images produced by a prior art printer where text printed near a trailing edge of a document exhibits degraded image quality due to the airflow near the printhead. The upper character is a character located on one side of the trailing edge of a medium sheet carried by a drum, the middle character is located in the center of the medium sheet, and the lower character is located at the opposite edge of the medium sheet. The air disruption discussed below with regard to FIG. 5 explains the scattered ink in the characters.

FIG. 5 illustrates the airflow that produces the degraded image quality shown in FIG. 6. FIG. 5 is a side-view schematic diagram illustrating a portion of a printing device 420. The printhead 424 is supported in a frame 414 along with a baseplate 416. Media sheets 428 are carried by a drum surface 418, shown as a portion in the figure, with a gap between the trailing edge of the rightmost sheet 428 and the leftmost sheet 428 as the sheets travel in the direction indicated by the arrow. The drum has holes and a vacuum source positioned below the drum surface 418 pulls air above the sheets against the sheets to hold the sheets to the drum. A gap between the frame 414 and the baseplate 416 enables air to follow path 422 through the gap between the printhead 424 and the trailing edge of the rightmost sheet 428 into the hole 126 as the printhead is ejecting ink onto the trailing edge. This air can displace the ink being ejected toward the trailing edge of the media sheet and produce the results shown in FIG. 6. A similar airflow produces similar results in ink ejected towards the leading edge of the next sheet. Thus, for printing systems that use a vacuum beneath a drum transport to hold media against the drum as the media pass the printheads, the areas between sheets produce a disruptive airflow. This airflow causes turbulence in the area between the printheads and the media sheets that deflects ink droplets from their intended trajectory. Consequently, improved media drum transport systems that provide suction force to hold print media in place while reducing or eliminating the negative effects of airflow due to exposed holes near printheads in the printer would be beneficial.

SUMMARY

In one embodiment, a media drum transport system reduces the negative effects of airflow through exposed holes around a workstation or print zone. The media drum transport system includes a drum having an arrangement of a plurality of rows of holes through the drum, each row of roles in the plurality of rows having at least one inter-copy gap that corresponds to a length of media sheet, the drum being configured for rotation in a process direction, a vacuum plenum positioned within the drum opposite a printhead, a vacuum source configured to pull air through holes in the drum opposite the vacuum plenum, and a shutter positioned within the vacuum plenum and interposed between the vacuum plenum and the drum, the shutter having a member with at least one aperture, a solid portion of the member preventing a flow of air between the vacuum plenum and a portion of the drum positioned opposite the solid portion of the shutter, the shutter being configured for movement in a cross-direction to enable the at least one aperture in the shutter to be aligned with at least one row of holes in the drum and selectively attenuate a flow of air from the holes in the at least one row of holes aligned with the at least one aperture in response to the at least one inter-copy gap in the at least one row being opposite the at least one aperture in the shutter.

A printer can incorporate the media drum transport system to reduce the negative effects of airflow through exposed holes near printheads. The printer includes at least one printhead, a drum having an arrangement of a plurality of rows of holes through the drum, each row of roles in the plurality of rows having at least one inter-copy gap that corresponds to a length of media sheet, the drum being configured for rotation in a process direction past the printhead to enable the printhead to eject marking material onto media sheets carried by the drum, a vacuum plenum positioned within the drum opposite the printhead, a vacuum source configured to pull air through holes in the drum opposite the vacuum plenum, and a shutter positioned within the vacuum plenum and interposed between the vacuum plenum and the drum, the shutter having a member with at least one aperture, a solid portion of the member preventing a flow of air between the vacuum plenum and a portion of the drum positioned opposite the solid portion of the shutter, the shutter being configured for movement in a cross-direction to enable the at least one aperture in the shutter to be aligned with at least one row of holes in the drum and selectively attenuate a flow of air from the holes in the at least one row of holes aligned with the at least one aperture in response to the at least one inter-copy gap in the at least one row being opposite the at least one aperture in the shutter.

BRIEF DESCRIPTION OF THE DRAWINGS

The foregoing aspects and other features of a media drum transport system and an inkjet printer including the media drum transport system are explained in the following description, taken in connection with the accompanying drawings.

DETAILED DESCRIPTION

Figure 1:
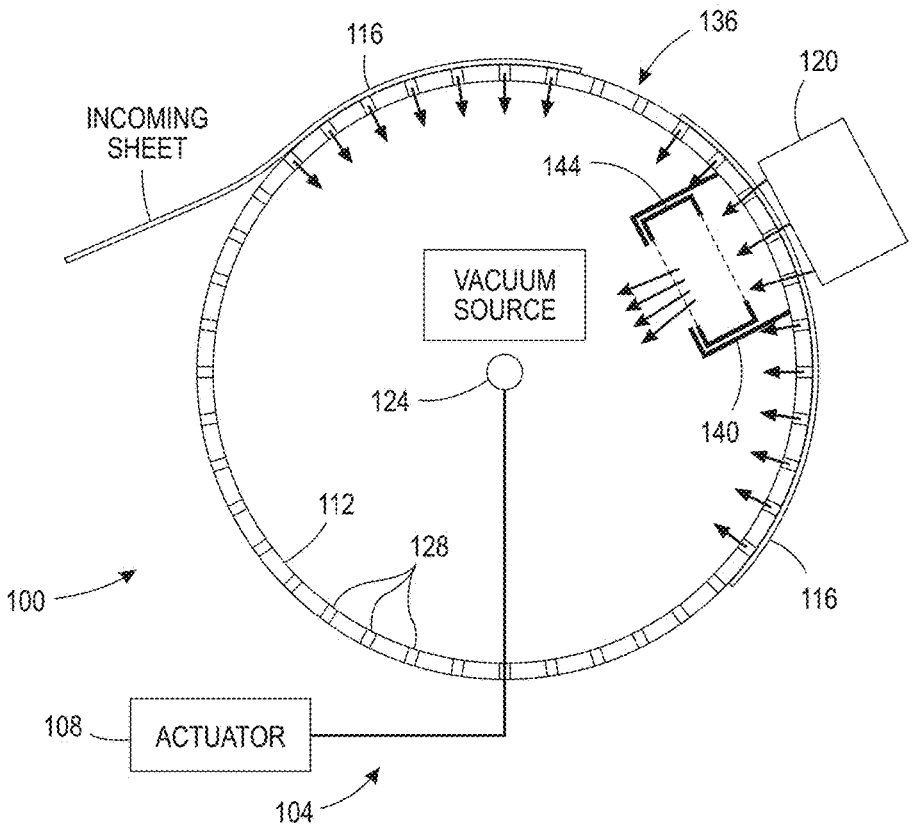
FIG. 1 is a schematic diagram of a media transport system having a rotating drum, a fixed plenum, and a sliding shutter within the plenum.

For a general understanding of the environment for the device disclosed herein as well as the details for the device, reference is made to the drawings. In the drawings, like reference numerals designate like elements.

As used herein, the word "printer" encompasses any apparatus that produces images with colorants on media, such as digital copiers, bookmaking machines, facsimile machines, multi-function machines, and the like. As used herein, the term "process direction" (P) refers to a direction of movement of print media through the printer including through a print zone including at least one printhead. For example, a media transport system includes a drum that moves in the process direction. The drum has a surface that carries print media along the process direction past at least one printhead in a print zone. The at least one printhead ejects drops of ink to form printed images on each print medium. A location that is "upstream" in the process direction relative to a component in the printer refers to a location that the print media passes prior to reaching the component, such as an upstream location that a print medium passes prior to reaching a printhead or other component in the printer. A location that is "downstream" in the process direction relative to a component in the printer refers to a location that the print media passes after reaching the component, such as a downstream location that a print medium passes after passing a printhead or other component in the printer. As used herein, the term "cross-process" direction (CP) refers to an axis that is perpendicular to the process direction along a surface of the drum and the print media on the surface of the belt.

As used herein, the term "vacuum plenum" refers to an apparatus that includes at least one chamber, a vacuum source, such as an electrical pump or fan system, and at least one opening that is configured to engage one surface of a drum in a media drum transport system. The vacuum source draws air through holes that are formed in the drum through the chamber and out an exhaust opening. A print medium placed on a surface of the drum opposite the surface that engages the opening to the chamber in the vacuum plenum covers a portion of the holes in the drum. The vacuum generated in the vacuum plenum applies a downward force to the print medium through the holes in the drum that are covered by the print medium.

As used herein, the term "drum" refers to at least one rotating member in a media transport system that has a surface configured to carry print media in the process direction through the printer. The drums described herein include holes arranged in a plurality of rows with each row including holes that are arranged substantially parallel to the process direction and multiple rows of holes are arranged across a width of the belt in the cross-process direction. One side of the drum exposes at least one opening that communicates with the vacuum plenum that is described above. On another side of the drum, the holes in the drum engage print media that the drum carries through the printer and the vacuum force through the holes that engage the print media holds the print media in a fixed position relative to the surface of the drum. Examples of drums include, but are not limited to, anodized aluminum drums and any other suitable drums.

As used herein, the term "inter-copy gap" refers to predetermined regions of the drum that lie between print media while the drum carries print media in the process direction. In one illustrative embodiment, an inter-copy gap of approximately 2.5 cm in length separates adjacent media sheets on the drum, although alternative embodiments use larger or smaller inter-copy gap sizes. The inter-copy gaps repeat at regular intervals along the length of the belt corresponding to the predetermined length of a print medium (e.g., every 210 mm or 297 mm for size A4 paper depending upon the paper being arranged width-wise or length-wise, respectively, on the drum). As described in more detail below, the drum includes no holes in the inter-copy gap locations for a portion of the rows of holes that are formed in the drum. To accommodate multiple print media sizes using a single drum, the drum includes no holes in two or more different rows of holes at different intervals for the inter-copy gaps of different sizes of print media that the drum carries in the media transport system. Additional details about specific embodiments of the drums and the structure of the inter-copy gaps are presented below.

As used herein, the term "shutter" refers to a solid member, such as a polymer or metallic sheet, with at least one aperture formed in the solid member. The aperture is aligned with one row of holes in the plurality of rows of holes formed in a drum corresponding to an inter-copy gap for a predetermined size of print medium that the drum carries during a print job. As described in more detail below, the shutter is positioned between the drum and the opening of the vacuum plenum at a location that is proximate to a printhead in the printer to reduce or eliminate airflow that the vacuum plenum produces in the inter-copy gap regions where the print medium does not cover holes in the drum. In some embodiments, an actuator adjusts the location of the shutter along the cross-process direction to align one or more apertures in the shutter with different sets of rows in the drum. Each set of rows has a different inter-copy gap interval to accommodate a different size of print medium. By moving a shutter to different positions under the drum prior to commencing a print job, the media transport system enables a single drum to accommodate multiple print media sizes. Additionally, the media transport system optionally includes two or more shutters along the process direction.

FIG. 1 is a schematic diagram of an inkjet printer 100 that includes a media transport system 104 having an actuator 108 operatively connected to the spindle of drum 112 to rotate the drum and carry media sheets 116 past printhead 120 for printing. A printed sheet is removed from the drum and transported to a bin for collection. The actuator 108 can be an electrical motor or the like that is operatively connected the spindle 124 that is aligned with the longitudinal axis of drum 112 to rotate the drum. The drum 112 has a plurality of holes 128 through the surface in a pattern described further below to enable a vacuum produced by vacuum source 132 to hold media sheets 116 against the surface of the drum 112. The pattern of the holes 128 described below provides solid areas called inter-copy gaps (ICGs) 136 at various locations on the drum surface. These ICGs are located to provide a solid area between the trailing edge of one media sheet and the leading edge of another media sheet or a solid area between the leading edge and trailing edge of the same media sheet. A plenum 140 and a shutter 144 are interposed between the vacuum source 132 and the surface of the drum 112. The plenum and the shutter are also positioned opposite the printhead 120 to adjust the vacuum pull against media sheets in the vicinity of the printhead 120.

Figure 2:
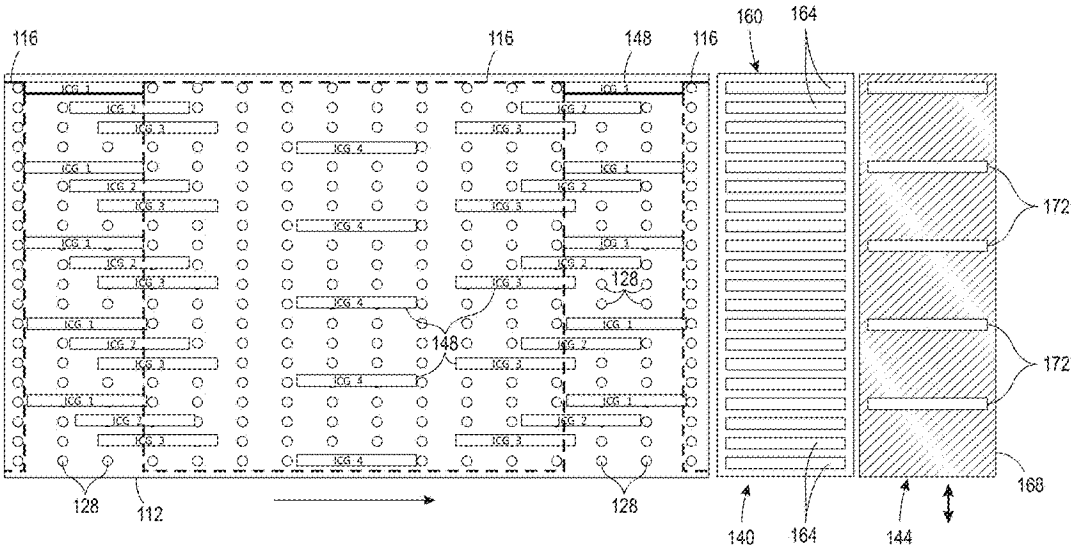
FIG. 2 is a schematic diagram of a portion of the media transport drum, the plenum, and the shutter of FIG. 1 that cooperate to help attenuate disruptive airflow at leading edges and trailing edges of media sheets.

FIG. 2 depicts an arrangement of the holes 128 in one embodiment of a drum 112 along with the structure of the plenum 140 and the shutter 144. The reader should understand that the drum portion, plenum, and shutter are shown side-by-side to facilitate the discussion of the different structures. As shown in FIG. 1, the shutter is positioned within the plenum 140 and configured for movement into and out of the plane of the FIG. 1 and in the cross-process direction as discussed below with reference to FIG. 2. This cross-process direction is perpendicular to the process direction defined by the rotational direction of the drum 112. Thus, by moving the shutter 144 the disruptive airflow at the trailing and leading edges of media sheets opposite the printhead is severely attenuated.

The pattern of the holes 128 has been interspersed with solid areas outlined with rectangles 148 and identified with the mnemonic ICG and a number. These rectangles are not embossed or otherwise marked at the drum 112, but are depicted in this manner in the figure to identify the solid areas of the drum that provide inter-copy gaps between media sheets of a particular size. That is, as the drum 112 moves in the direction of the arrow shown in the figure, a trailing edge of a sheet is positioned at or slightly overlapped with the right edge of an ICG rectangle and the leading edge of the sheet is positioned at or slightly overlapped with the left edge of the next rectangle in the process direction marked with the same ICG number. For example, a sheet of media having a length that is approximately the distance between a left edge of a rightmost ICG1 and a right edge of a leftmost ICG1 is depicted with the dashed line box in the figure. The trailing edge of the preceding sheet is shown by the dashed line at the right side of the drum portion depicted and the leading edge of the following sheet is shown by the dashed line at the left side of the drum portion depicted.

By providing the ICGs at different positions in the rows of holes on the drum, different sizes of media can be positioned on the drum between corresponding ICGs. For example, media sheets positioned between ICG1 areas are approximately as long as the distance between ten holes in a row while media sheets positioned between ICG2 areas are approximately as long as the distance between eight holes in a row. That is, the distance between ICGs in the same row is configured to accommodate a predetermined length of media. Each length is associated with a particular pitch, which refers to a predetermined size of media on the drum at a predetermined orientation. Thus, the configuration of holes 128 and ICGs 148 provides a predetermined number of pitches for a drum. In the configuration shown in FIG. 2, four pitches are shown, although fewer or more pitches could be configured in a drum.

With continued reference to FIG. 2, the plenum 140 includes a solid member 160 with a plurality of slots 164. The solid member 160 has a length in the cross-process direction that is approximately the same as the length of the drum 112 in the same direction. The slots 164 have a width in the process direction that is slightly longer than a width of an ICG in that direction and a length in the cross-process direction that is approximately the same as a length of an ICG in the same direction. The plenum 140 has a number of slots 164 that is the same as the number of rows of holes 128 in the drum. A row of holes is composed of a line of holes in the drum in the process direction. Thus, the plenum enables a vacuum to pull through a portion of any row of holes in the drum provided the flow path from the holes in the portion of the row opposite the plenum are not otherwise obstructed. The shutter 144 has a solid member 168 and a predetermined number of slots 172. The slots have a width in the process direction that is slightly longer than a width of an ICG in the same direction and a length in the cross-process direction that is approximately the same as a length of an ICG in the same direction. The number of slots in the shutter is the same as the number of ICGs for a single pitch in the cross-process direction and these slots are positioned from one another by the number of rows of holes between ICGs for a single pitch in the cross-process direction.

Figure 5:
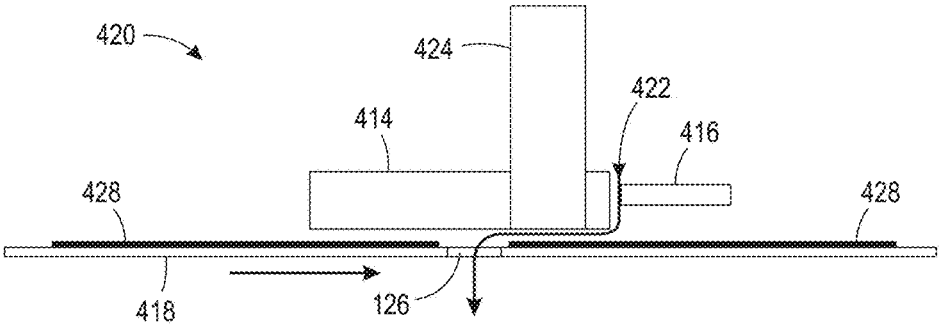
FIG. 5 PRIOR ART
FIG. 5 illustrates the structure in a printer having a media drum that produces disruptive airflow at the trailing edges and leading edges of media sheets as they pass the printheads in the printer.
Figure 6:
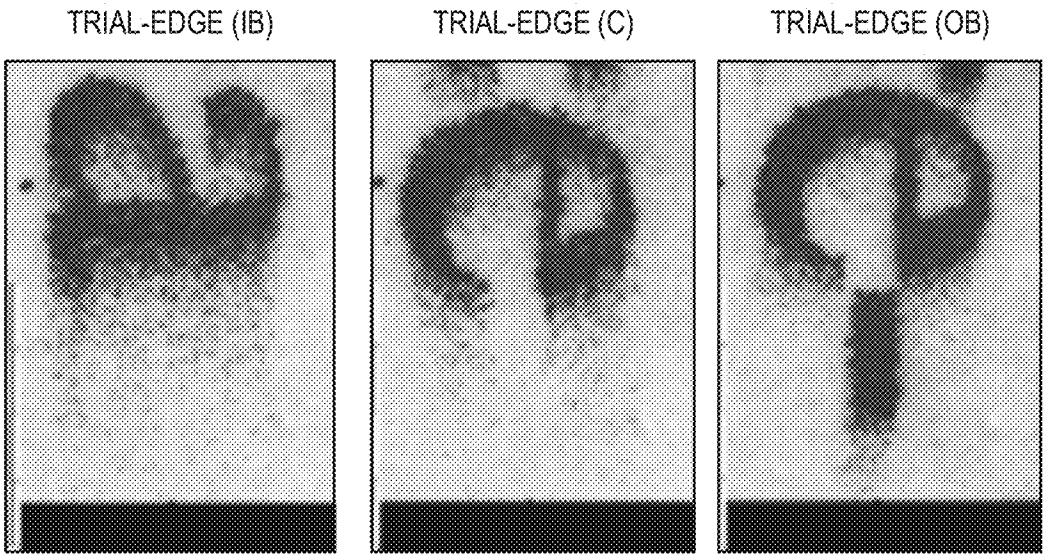
FIG. 6 PRIOR ART
FIG. 6 is a depiction of printed text produced by a prior art printer. The text includes degraded image quality due to the effects of airflow near the printhead from exposed holes in a drum and vacuum plenum that draws air through the holes proximate to the printhead.

The configuration shown in FIG. 2 demonstrates that when the shutter 144 is positioned between the plenum 140 and the drum 112 it enables airflow through the drum when a portion of a row of holes in the drum 112 is aligned with a slot 172 in the shutter 144 and a slot 164 in the plenum 140. When an ICG is aligned with a slot 172 in the shutter 144, however, no air flows through the drum to the plenum since no holes are present in the ICG and no air flows through the holes in adjacent rows to slots in the plenum since these flow paths are blocked by the solid portions of the member 168 of the shutter 144 between the slots 172. Thus, when the shutter is positioned so the ICGs for a particular pitch are aligned with slots 172 in the shutter 144, the ICGs and the solid portion of the shutter stop air flow through the plenum at predetermined positions. These positions only occur at the trailing and leading edges of the media corresponding to the pitch for the ICGs that are aligned with the slots 172 in the shutter 144. Therefore, by moving the shutter so the slots 172 are aligned with the ICGs for a particular pitch, the printer is adjusted to block airflow at the trailing and leading edges of the media sheets to attenuate ink drop displacement caused by the air flow depicted in FIG. 5.

Figure 3:
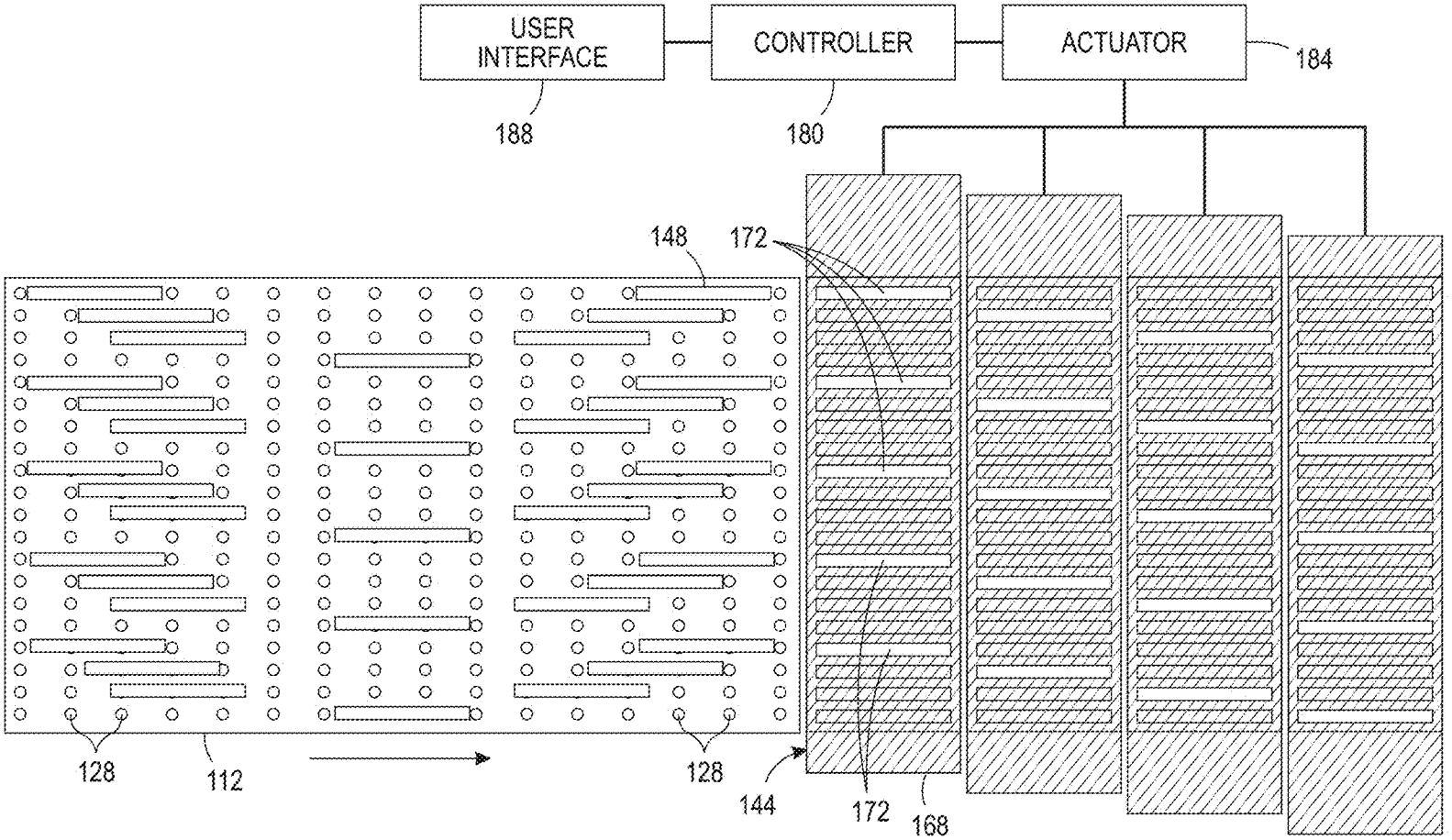
FIG. 3 is a schematic diagram of the portion of the media drum transport system and the various positions for the shutter that attenuate disruptive airflow for different sizes of media sheets.

FIG. 3 shows a controller 180 operatively connected to an actuator 184 for moving shutter 144 selectively to accommodate airflow for different sizes of media sheets. Although the actuator 184 is connected to only one shutter, four depictions of shutter 144 are presented to demonstrate the four positions that the shutter can take for the four pitch configuration of drum 112 shown in FIG. 2. At position 1, the slots 172 in member 168 of the shutter 144 are aligned with the rows containing ICG1. At position 2, the slots 172 in member 168 of the shutter 144 are aligned with the rows containing ICG2. At position 3, the slots 172 in member 168 of the shutter 144 are aligned with the rows containing ICG3. At position 4, the slots 172 in member 168 of the shutter 144 are aligned with the rows containing ICG4. As noted above, when the ICGs pass beneath the slots 172 in the shutter 144, the disruptive airflow at the leading and trailing edges of media sheets is attenuated. Thus, by using the controller 180 to operate the actuator 184, the shutter is moved to improve the image quality for the different sizes of media sheets being printed by the printhead 120.

A process 300 for operating the media transport system described above is shown in FIG. 4. In the description of the method, statements that the method is performing some task or function refers to a controller or general purpose processor executing programmed instructions stored in non-transitory computer readable storage media operatively connected to the controller or processor to manipulate data or to operate one or more components in the printer to perform the task or function. The controller 180 noted above can be such a controller or processor. Alternatively, the controller can be implemented with more than one processor and associated circuitry and components, each of which is configured to form one or more tasks or functions described herein. Additionally, the steps of the method may be performed in any feasible chronological order, regardless of the order shown in the figures or the order in which the steps are described.

Figure 4:
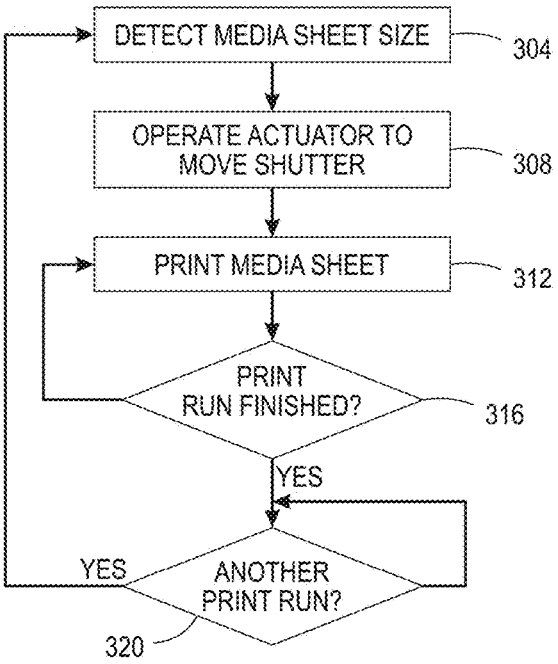
FIG. 4 is a flow diagram of a process for operating the media transport system of FIG. 1.

The process of FIG. 4 detects with the controller the size of the media sheets to be carried by the transport system and printed (block 304). The size of the sheets can be input to the controller through a user interface 188 (FIG. 3) or detected by sensors in the feed path to the drum 112 that are connected to the controller 180. The controller 180 operates the actuator 184 to move the shutter 144 so the slots 172 in the member 169 are aligned with the rows of holes that contain the ICGs that correspond to the media sheet size (block 308). The process continues with the media sheets being fed to the drum 112 for printing by the printhead 120 (block 312) until the run of sheets has been printed (block 316). When the run is finished, the controller waits until another run of sheets is to be printed so the process can be repeated (block 320).

It will be appreciated that variants of the above-disclosed and other features and functions, or alternatives thereof, may be desirably combined into many other different systems, applications or methods. Various presently unforeseen or unanticipated alternatives, modifications, variations or improvements may be subsequently made by those skilled in the art that are also intended to be encompassed by the following claims.

What is claimed:

1. A media transport system comprising:

a drum having an arrangement of a plurality of rows of holes through the drum, each row of holes in the plurality of rows having at least one inter-copy gap that corresponds to a length of media sheet, the drum being configured for rotation in a process direction;

a vacuum plenum positioned within the drum opposite a printhead;

a vacuum source configured to pull air through holes in the drum opposite the vacuum plenum; and a shutter positioned within the vacuum plenum and interposed between the vacuum plenum and the drum, the shutter having a member with at least one aperture, a solid portion of the member preventing a flow of air between the vacuum plenum and a portion of the drum positioned opposite the solid portion of the shutter, the shutter being configured for movement in a cross-direction to enable the at least one aperture in the shutter to be aligned with at least one row of holes in the drum and selectively attenuate a flow of air from the holes in the at least one row of holes aligned with the at least one aperture in response to the at least one inter-copy gap in the at least one row being opposite the at least one aperture in the shutter.

2. The media transport system of claim 1 further comprising:

an actuator operatively connected to the shutter; and a controller operatively connected to the actuator, the controller being configured to operate the actuator to move the shutter in the cross-process direction.

3. The media transport system of claim 2, the controller being further configured to detect a size of a media sheet and operate the actuator to move the shutter in the cross-process direction to enable the at least one aperture to align with the at least one row of holes in the drum having the inter-copy gap that corresponds to the detected media sheet size.

4. The media transport system of claim 1, the shutter further comprising:

a plurality of apertures in the member of the shutter, the apertures being positioned in the member at a predetermined distance in the cross-process direction to correspond with the rows of holes in the drum that have inter-copy gaps that correspond to the same size of media sheets.

5. The media transport system of claim 1 wherein each aperture in the shutter has a predetermined length in the process direction that corresponds to a predetermined length of the at least one inter-copy gap in the rows of holes in the drum.

6. The media transport system of claim 1 wherein the inter-copy gaps in the plurality of rows of holes correspond to a plurality of media sheet sizes.

7. The media transport system of claim 6 wherein the inter-copy gaps in one row of holes in the drum correspond to a media size that is different than the media size to which the inter-copy gaps in an adjacent row of holes correspond.

8. The media transport system of claim 1 wherein in the vacuum plenum has a plurality of apertures, each aperture in the plurality of apertures corresponding to a different row of holes in the drum.

9. A printer comprising:

at least one printhead;

a drum having an arrangement of a plurality of rows of holes through the drum, each row of holes in the plurality of rows having at least one inter-copy gap that corresponds to a length of media sheet, the drum being configured for rotation in a process direction past the printhead to enable the printhead to eject marking material onto media sheets carried by the drum;

a vacuum plenum positioned within the drum opposite the printhead;

a vacuum source configured to pull air through holes in the drum opposite the vacuum plenum; and a shutter positioned within the vacuum plenum and interposed between the vacuum plenum and the drum, the shutter having a member with at least one aperture, a solid portion of the member preventing a flow of air between the vacuum plenum and a portion of the drum positioned opposite the solid portion of the shutter, the shutter being configured for movement in a cross-direction to enable the at least one aperture in the shutter to be aligned with at least one row of holes in the drum and selectively attenuate a flow of air from the holes in the at least one row of holes aligned with the at least one aperture in response to the at least one inter-copy gap in the at least one row being opposite the at least one aperture in the shutter.

10. The printer of claim 9 further comprising:

an actuator operatively connected to the shutter; and a controller operatively connected to the actuator, the controller being configured to operate the actuator to move the shutter in the cross-process direction.

11. The printer of claim 10, the controller being further configured to detect a size of a media sheet and operate the actuator to move the shutter in the cross-process direction to enable the at least one aperture to align with the at least one row of holes in the drum having the inter-copy gap that corresponds to the detected media sheet size.

12. The printer of claim 9, the shutter further comprising:

a plurality of apertures in the member of the shutter, the apertures being positioned in the member at a predetermined distance in the cross-process direction to correspond with the rows of holes in the drum that have inter-copy gaps that correspond to the same size of media sheets.

13. The printer of claim 9 wherein each aperture in the shutter has a predetermined length in the process direction that corresponds to a predetermined length of the at least one inter-copy gap in the rows of holes in the drum.

14. The printer of claim 9 wherein the inter-copy gaps in the plurality of rows of holes correspond to a plurality of media sheet sizes.

15. The printer of claim 14 wherein the inter-copy gaps in one row of holes in the drum correspond to a media size that is different than the media size to which the inter-copy gaps in an adjacent row of holes correspond.

16. The printer of claim 9 wherein in the vacuum plenum has a plurality of apertures, each aperture in the plurality of apertures corresponding to a different row of holes in the drum.

17. A method of operating a printer having a drum configured with a plurality of rows of holes, each row of holes in the plurality of rows having at least one inter-copy gap that corresponds to a length of media sheet, the drum being configured for rotation in a process direction past the printhead to enable the printhead to eject marking material onto media sheets carried by the drum, the method comprising:

operating a vacuum source to pull air through holes in the drum opposite a vacuum plenum positioned within the drum opposite the printhead; and moving a shutter positioned within the vacuum plenum and interposed between the vacuum plenum and the drum in a cross-process direction to enable a solid portion of a member of the shutter to prevent a flow of air between the vacuum plenum and a portion of the drum positioned opposite the solid portion of the shutter and to enable at least one aperture in the shutter to be aligned with at least one row of holes in the drum to attenuate selectively a flow of air from the holes in the at least one row of holes aligned with the at least one aperture in response to the at least one inter-copy gap in the at least one row being opposite the at least one aperture in the shutter.

18. The method of claim 17, the moving of the shutter further comprising:

detecting with a controller a size of a media sheet; and operating with the controller an actuator operatively connected to the shutter to move the shutter in the cross-process direction to enable the at least one aperture to align with the at least one row of holes in the drum having the inter-copy gap that corresponds to the detected media sheet size.

19. The method of claim 18, the moving of the shutter further comprising:

operating the actuator with the controller to move the shutter to align a plurality of apertures in the shutter positioned at a predetermined distance in the cross-process direction to correspond with the rows of holes in the drum that have inter-copy gaps that correspond to media sheets having the same size.

* * * * *